US009714747B2

(12) United States Patent
Tsukamoto

(10) Patent No.: US 9,714,747 B2
(45) Date of Patent: Jul. 25, 2017

(54) VEHICLE LAMP

(71) Applicant: KOITO MANUFACTURING CO., LTD., Tokyo (JP)

(72) Inventor: Michio Tsukamoto, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 39 days.

(21) Appl. No.: 14/822,067

(22) Filed: Aug. 10, 2015

(65) Prior Publication Data

US 2016/0040848 A1 Feb. 11, 2016

(30) Foreign Application Priority Data

Aug. 11, 2014 (JP) ..... 2014-163370

(51) Int. Cl.
*B60Q 1/04* (2006.01)
*F21S 8/10* (2006.01)

(52) U.S. Cl.
CPC ..... *F21S 48/1763* (2013.01); *F21S 48/1104* (2013.01); *F21S 48/1159* (2013.01); (Continued)

(58) Field of Classification Search
CPC ..... F21S 48/1104; F21S 48/1159; F21S 48/1241; F21S 48/125; F21S 48/1258; (Continued)

(56) References Cited

U.S. PATENT DOCUMENTS

2003/0090906 A1 5/2003 Hayakawa
2004/0156209 A1* 8/2004 Ishida ..... F21S 48/145 362/516

(Continued)

FOREIGN PATENT DOCUMENTS

| | | | |
|---|---|---|---|
| CN | 101178160 | A | 5/2008 |
| EP | 1500869 | A1 | 1/2005 |
| FR | 2823833 | A1 | 10/2002 |
| JP | 2005108554 | A | 4/2005 |

OTHER PUBLICATIONS

Communication issued Apr. 21, 2017, issued by the State Intellectual Property Office of the People's Republic of China in counterpart Chinese Patent Application No. 201510490694.6.

*Primary Examiner* — Y M Lee
(74) *Attorney, Agent, or Firm* — Sughrue Mion, PLLC

(57) ABSTRACT

A vehicle lamp includes a projection lens and a first light source. Light emitted from the first light source is irradiated forward through the projection lens. The shade blocks a part of light from the first light source toward the projection lens to form a low beam light distribution pattern. The light emitting unit causes light to be incident onto the projection lens to form a high beam supplementary light distribution pattern. The light emitting unit includes a second light source and a transparent member. Light emitted from the second light source is incident on the transparent member. The transparent member emits the incident light from the front end surface thereof. An emission window is formed in the upper surface of the transparent member and in rear of a front edge of the upper surface. The emission window emits the light incident onto the transparent member, toward the projection lens.

4 Claims, 7 Drawing Sheets

(52) U.S. Cl.
CPC ..... *F21S 48/125* (2013.01); *F21S 48/1241* (2013.01); *F21S 48/1258* (2013.01); *F21S 48/1323* (2013.01); *F21S 48/142* (2013.01); *F21S 48/145* (2013.01); *F21S 48/1747* (2013.01)

(58) Field of Classification Search
CPC .... F21S 48/1323; F21S 48/142; F21S 48/145; F21S 48/1747; F21S 48/12; F21S 48/14; F21S 48/22; F21S 48/2212; F21S 48/2225; F21S 48/2237; F21S 48/2231; F21S 48/2243; F21S 448/225; F21S 48/2256; F21S 48/2262; F21S 48/2287; F21S 48/2293; F21S 48/2268
See application file for complete search history.

(56) References Cited

U.S. PATENT DOCUMENTS

| | | | | |
|---|---|---|---|---|
| 2005/0068787 | A1 | 3/2005 | Ishida | |
| 2008/0112180 | A1 | 5/2008 | Okada | |
| 2008/0198574 | A1* | 8/2008 | Woodward et al. | F21S 48/1154 362/85 |
| 2012/0262935 | A1 | 10/2012 | Yamamoto | |
| 2013/0194816 | A1* | 8/2013 | Hager et al. | F21S 48/1225 362/487 |
| 2015/0176793 | A1* | 6/2015 | Park et al. | F21S 48/1241 362/511 |

* cited by examiner

VEHICLE LAMP

CROSS REFERENCE TO RELATED APPLICATION(S)

This application is based on and claims priority under 35 U.S.C. §119 to Japanese Patent Application No. 2014-163370 filed on Aug. 11, 2014, the entire contents of which are incorporated herein by reference.

BACKGROUND

Technical Field

Exemplary embodiments of the invention relate to a projector type vehicle lamp.

Related Art

Projector type vehicle lamps have been known in which light from a light source disposed in rear of a projection lens is emitted forward by the projection lens.

JP 2005-108554 A (corresponding to US 2005/0068787 A1) describes such a configuration that low beam illumination and high beam illumination are selectively performed by using such a projector type vehicle lamp.

In this vehicle lamp, a part of light heading from a first light source to the projection lens is blocked by a shade so as to form a low beam light distribution pattern. Also, light emitted from a second light source is incident on the projection lens so as to additionally form a high beam supplementary light distribution pattern. A combination of the low beam light distribution pattern and the high beam supplementary light distribution pattern make up a high beam light distribution pattern.

SUMMARY

In the vehicle lamp described in JP 2005-108554 A, the shade separates the light emitted from the first light source and the light emitted from the second light source at a rear focal plane of the projection lens. Therefore, the low beam light distribution pattern and the high beam supplementary light distribution pattern do not overlap each other. If a leading end portion of the shade has any sort of thickness, a gap would be formed between the low beam light distribution pattern and the high beam supplementary light distribution pattern.

Exemplary embodiments of the invention have been made in view of the above circumstances, and provide a vehicle lamp that is configured to be capable of selectively performing low beam illumination and high beam illumination and to be capable of forming a high beam light distribution pattern with a smooth continuity between a low beam light distribution pattern and a high beam supplementary light distribution pattern.

In order to obtain the above-described vehicle lamp, one exemplary embodiment devises a configuration that a light emitting unit for forming a high beam supplementary light distribution pattern is provided with a transparent member.

(1) A vehicle lamp is configured so as to be capable of selectively performing low beam illumination and high beam illumination. The vehicle lamp includes a projection lens and a first light source. The first light source is disposed in rear of the projection lens. Light emitted from the first light source is irradiated forward through the projection lens. A shade and a light emitting unit are disposed in rear of the projection lens. The shade blocks a part of light heading from the first light source toward the projection lens to form a low beam light distribution pattern. The light emitting unit causes light to be incident onto the projection lens to form a high beam supplementary light distribution pattern additionally to the low beam light distribution pattern. The light emitting unit includes a second light source and a transparent member. The transparent member includes a front end surface. Light emitted from the second light source is incident on the transparent member. The transparent member is configured to emit the incident light from the front end surface. The shade is configured by performing surface treatment on an upper surface of the transparent member. An emission window is formed in the upper surface of the transparent member and in rear of a front edge of the upper surface. The emission window is configured to emit the light, which is incident from the second light source onto the transparent member, toward the projection lens.

The light from the first light source may be incident onto the projection lens as direct light. Alternatively, the light from the first light source may be reflected by a reflector and then be incident onto the projection lens as reflected light.

The "first light source" and "second light source" are not particularly limited. Examples of the first and second light sources include (i) light emitting elements such as light emitting diodes and laser diodes, and (ii) bulb light sources.

The "shade" is configured by performing surface treatment to the upper surface of the transparent member. It should be noted that the "surface treatment" method is not particularly limited, so long as the light from the first light source is prevented from being incident onto the transparent member. Examples of the surface treatment include (i) Mirror-surface treatment such as aluminum deposition or (ii) non-reflective treatment such as a black coating.

The specific shape and material properties of the "transparent member" are not particularly limited, so long as the light which is incident from the second light source onto the transparent member is emitted from the front end face and the emission window toward the projection lens.

The specific arrangement and shape of the "emission window" are not particularly limited, so long as the emission window is formed to be separated from the front edge of the upper surface of the transparent member and in rear of the front edge of the upper surface of the transparent member.

As described in the above configuration, the vehicle lamp is configured to be a projector type vehicle lamp that selectively performs low beam illumination and high beam illumination. Also, the vehicle lamp includes the light emitting unit for forming the high beam supplementary light distribution pattern. The light emitting unit includes the second light source and the transparent member. The shade blocks a part of the light from the first light source. The shade is configured by performing surface treatment to the upper surface of the transparent member. The transparent member is configured so as to emit the light, which is incident from the second light source, from the front end face and the emission window of the upper surface toward the projection lens. This configuration provides the following advantageous effects.

The basic shape of the high beam supplementary light distribution pattern can be formed by the light emitted from the front end surface of the transparent member. Also, the high beam supplementary light distribution pattern can be formed by the light emitted from the emission window, so as to extend to a region below a cut-off line of the low beam light distribution pattern.

Thereby, it is possible to prevent a gap between the low beam light distribution pattern and the high beam supplementary light distribution pattern from being formed. As a result, the continuity between the low beam light distribution pattern and the high beam supplementary light distribution pattern can be enhanced.

Accordingly, the vehicle lamp of (1) can selectively perform the low beam illumination and the high beam illumination and can form the high beam light distribution pattern with the smooth continuity between the low beam light distribution pattern and the high beam supplementary light distribution pattern.

(2) In the vehicle lamp of (1), the upper surface of the transparent member may include a region in front of the emission window. The region of the upper surface of the transparent member may make up a front reflecting surface extending obliquely downward and rearward from the front edge of the upper surface.

With this configuration, the front reflecting surface reflects a part of light emitted from the emission window, so that the reflected light can be utilized to form the high beam supplementary light distribution pattern. As a result, it is possible further enhance the continuity between the low beam light distribution pattern and the high beam supplementary light distribution pattern.

(3) In the vehicle lamp of any one of (1) and (2), the transparent member may include a plurality of transparent segments which are disposed in parallel in right and left directions. The second light source may include a plurality of light emitting elements that are disposed so that light emitted from the light emitting elements is incident onto the transparent segments, respectively. The plurality of light emitting elements may be configured so as to be capable of individually being turned on. With this configuration, the following advantageous effects can be achieved.

That is, the supplementary light distribution pattern can be formed by simultaneously turning on the plural light emitting elements. Thereby, a high beam light distribution pattern can be formed. Also, a supplementary light distribution pattern in which a part of the above-described supplementary light distribution pattern is missing can be formed by selectively turning on a portion of the plural light emitting elements. Thereby, an intermediate light distribution pattern having an intermediate shape between the low beam light distribution pattern and the high beam light distribution pattern can be formed.

BRIEF DESCRIPTION OF THE DRAWINGS

FIGS. 5A and 5B are views illustrating light distribution patterns formed on a virtual vertical screen located at a position 25*m* ahead of the vehicle lamp, by light emitted forward from the vehicle lamp, FIGS. 5A and 5B showing the light distribution patterns to be seen through;

DETAILED DESCRIPTION

Exemplary embodiments of the invention will be described below with reference to the accompanying drawings.

Figure 1:
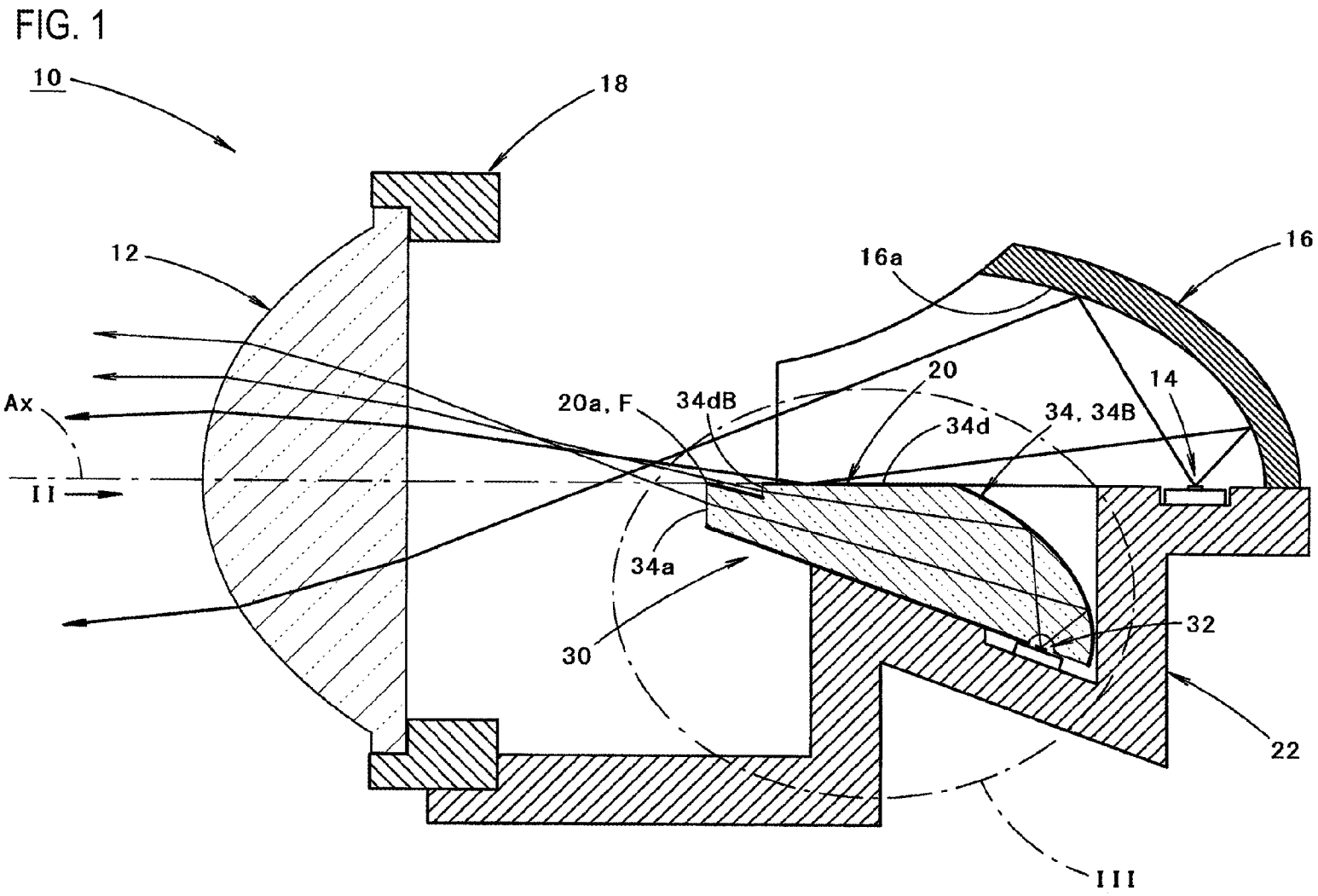
FIG. 1 is a side cross-section view illustrating a vehicle lamp according to one exemplary embodiment of the invention.
Figure 2:
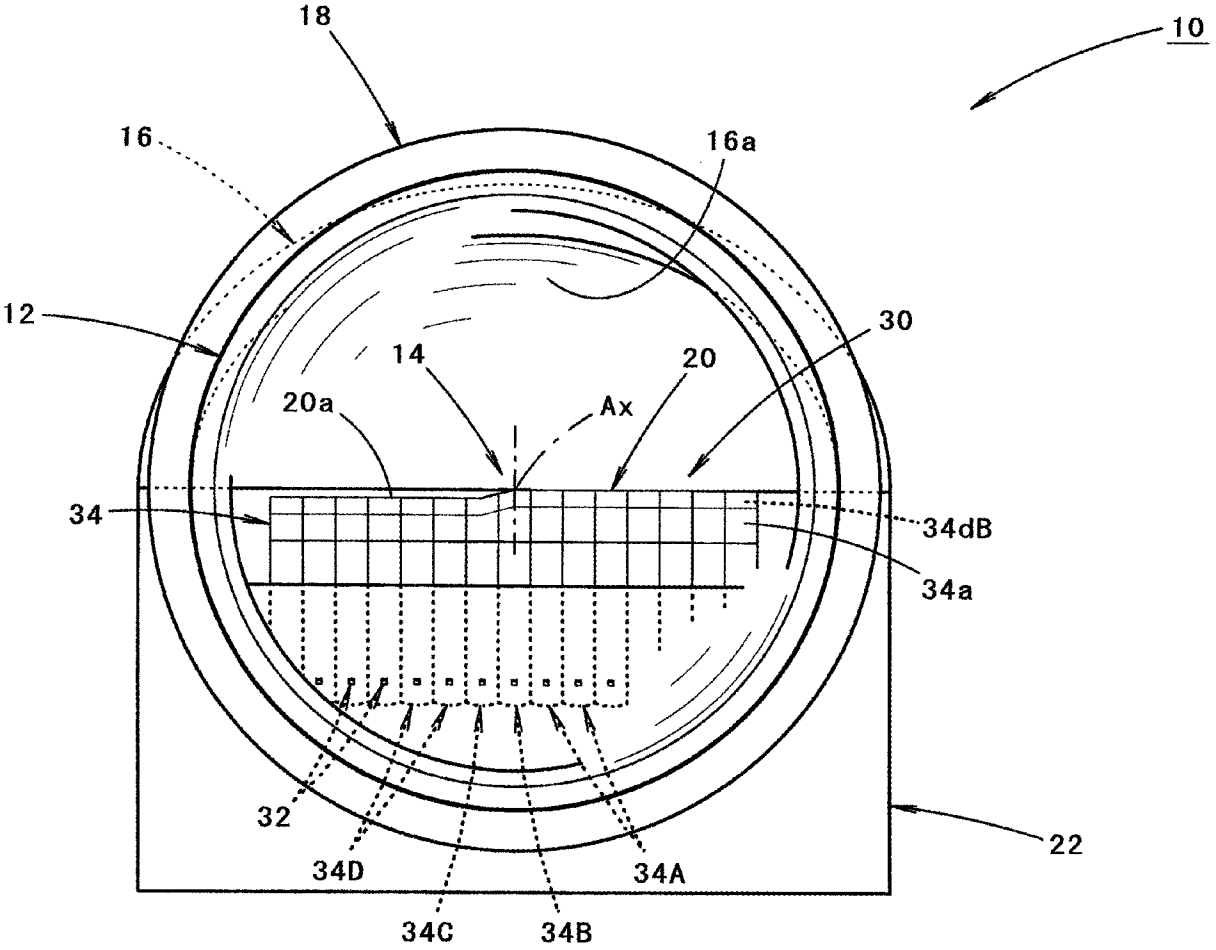
FIG. 2 shows the vehicle lamp according to the exemplary embodiment when viewed along a direction of an arrow II in FIG. 1.
Figure 3:
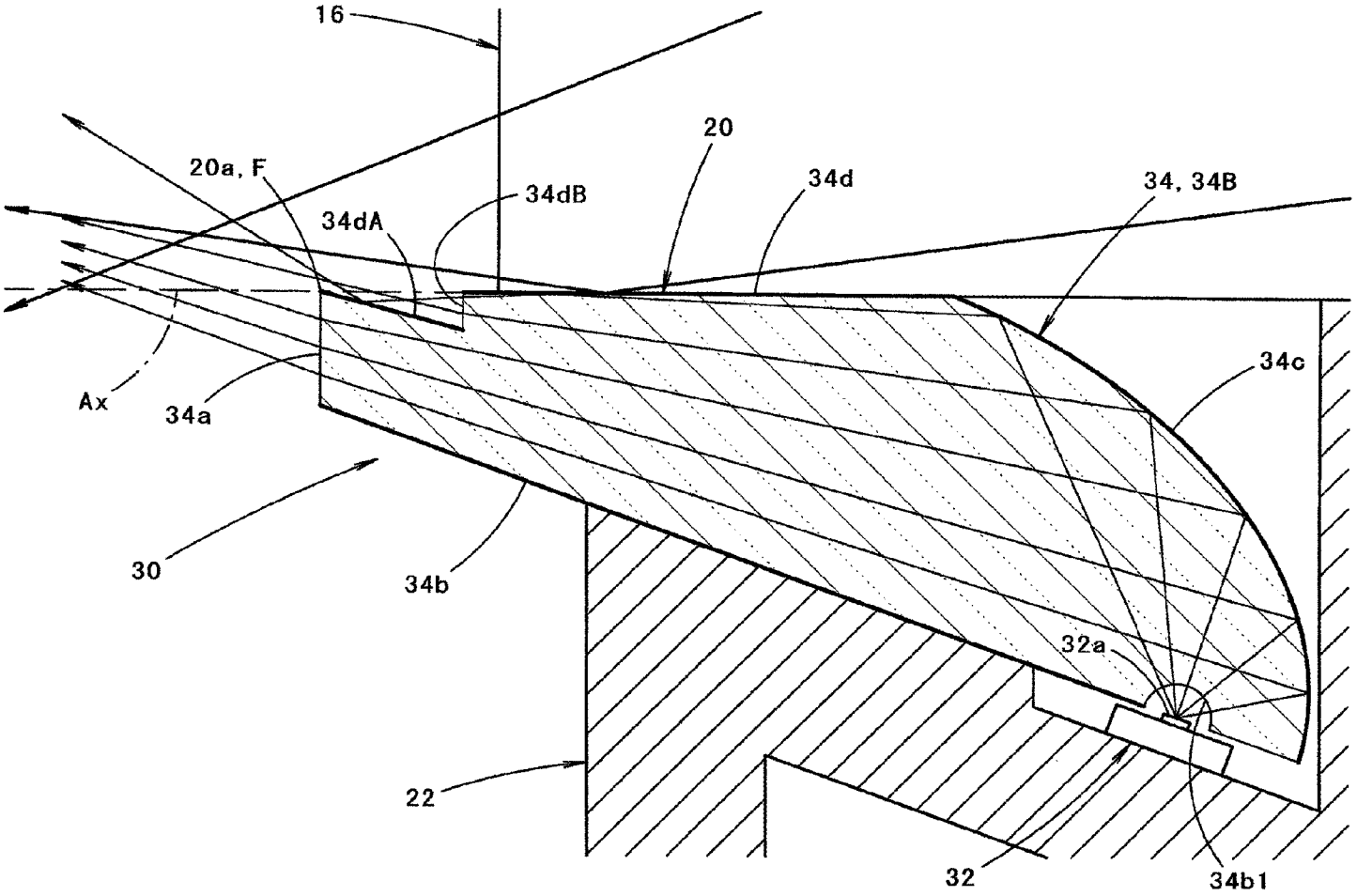
FIG. 3 is a detailed view of a portion III in FIG. 1.
Figure 4:
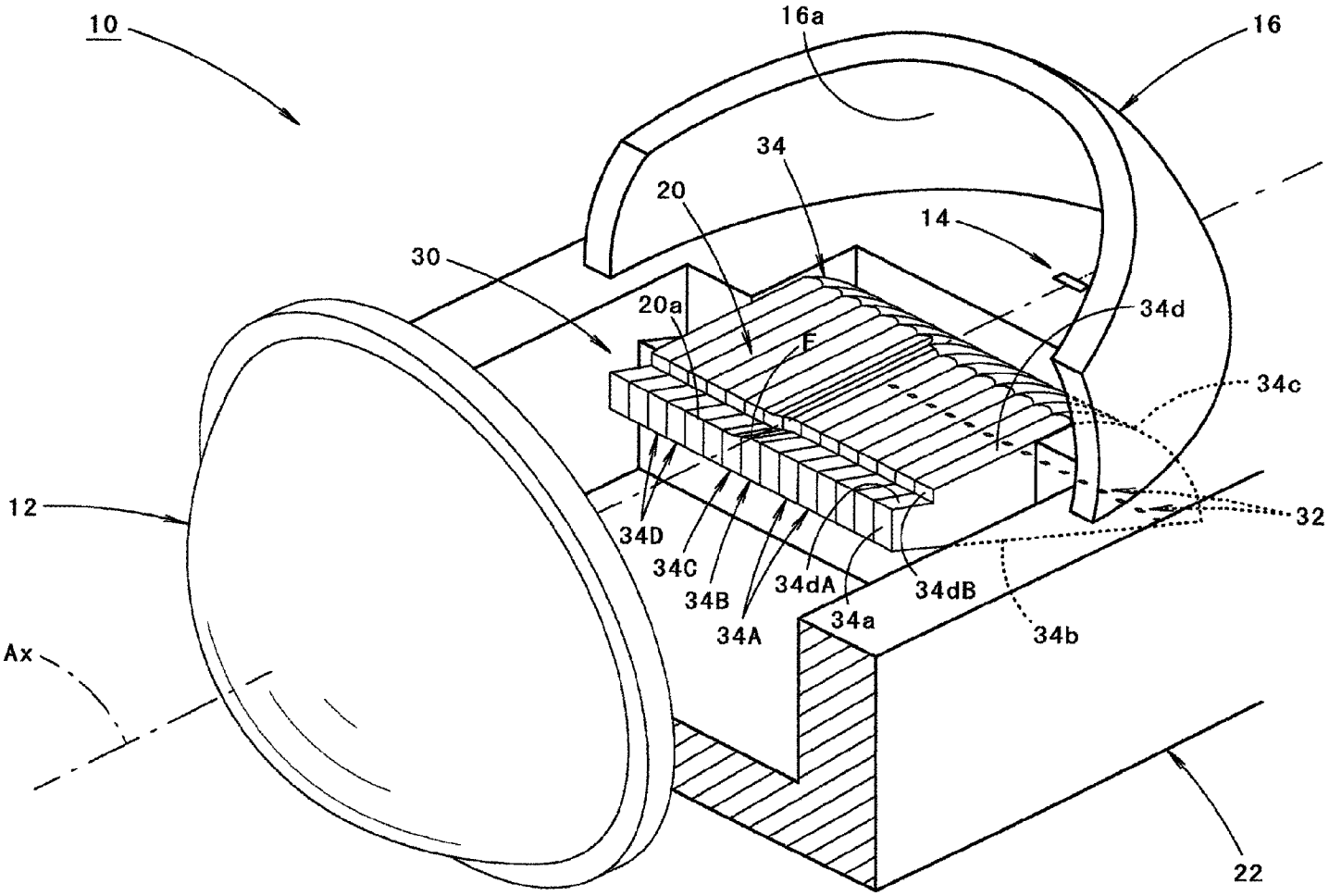
FIG. 4 is a perspective view illustrating main elements of the vehicle lamp.

FIG. 1 is a side cross-section view illustrating a vehicle lamp 10 according to an exemplary embodiment of the invention. FIG. 2 shows the vehicle lamp 10 when viewed along a direction of an arrow II in FIG. 1. FIG. 3 is a detailed view of a portion III in FIG. 1. FIG. 4 is a perspective view illustrating main elements of the vehicle lamp 10.

As shown in FIGS. 1 to 4, the vehicle lamp 10 according to the exemplary embodiment is a headlamp that can selectively perform low beam illumination and high beam illumination. The vehicle lamp 10 is of a projector type.

That is, the vehicle lamp 10 is configured to include a projection lens 12, a light emitting element 14, and a reflector 16. The projection lens 12 has an optical axis Ax extending in vehicle front and rear directions. The light emitting element 14 serves as a light source. The light emitting element 14 is disposed on a rear side of a rear focal point F of the projection lens 12. The reflector 16 is disposed so as to cover the light emitting element 14 from above. The reflector 16 reflects light from the light emitting element 14 toward the projection lens 12.

Also, the vehicle lamp 10 is configured to include a shade 20 and a light emitting unit 30. The shade 20 blocks a part of light heading from the light emitting element 14 to the projection lens 12, so as to form a low beam light distribution pattern. The light emitting unit 30 causes light to be incident on the projection lens 12 in order to additionally form a high beam supplementary light distribution pattern with respect to the low beam light distribution pattern.

The vehicle lamp 10 is configured so that the optical axis Ax directs slightly downward with respect to the vehicle front and rear directions in a state where adjustment of the optical axis Ax has been completed.

Next, the specific configuration of the vehicle lamp 10 will be described.

The projection lens 12 is a planoconvex aspherical lens having a convex front surface and a planar rear surface. The projection lens 12 inverts and projects a light-source image formed in a rear focal plane of the projection lens 12 onto a virtual vertical screen ahead of the vehicle lamp 10. The rear focal plane includes the rear focal point F of the projection lens 12.

A lens holder 18 supports the projection lens 12 at an outer peripheral flange portion of the projection lens 12. Also, a base member 22 supports the lens holder 18.

The light emitting element 14 is a white light emitting diode. The light emitting element 14 includes a light emitting surface having a laterally elongated rectangle shape. The light emitting element 14 is disposed to face upward in a state where the light emitting surface of the light emitting element 14 is located in a horizontal plane including the optical axis Ax. The light emitting element 14 is supported by the base member 22.

A reflecting surface 16*a* of the reflector 16 is configured by a curved surface which is a substantially elliptical surface having a long axis substantially identical to the optical axis Ax and having a first focal point at a light emission center of the light emitting element 14. The eccentricity of the reflecting surface 16*a* gradually increases from a vertical cross-section toward a horizontal cross-section. Therefore, the reflector 16 converges light from the light emitting element 14 at a point that is located slightly ahead of the rear focal point F in vertical cross-section. The convergence position of the reflector 16 in horizontal cross-section is somewhat further ahead of the rear focal point F. The reflector 16 is supported by the base member 22.

The light emitting unit 30 is configured to include a transparent member 34 and plural light emitting elements 32. The transparent member 34 is disposed below the rear focal point F of the projection lens 12. The light emitting elements 32 serve as a second light source. Light emitted from the light emitting elements 32 is incident on the transparent member 34. Specific configuration of the light emitting unit 30 will be described later.

The shade 20 is formed by performing mirror treatment (such as aluminum deposition) onto an upper surface 34*d* of the transparent member 34 making up the light emitting unit 30.

The shade 20 blocks a part of the light which is emitted from the light emitting element 14 and which is reflected by the reflector 16. Also, the shade 20 reflects the blocked light upward so as to be incident on the projection lens 12. This incident light is emitted forward from the projection lens 12 as downward light.

The shade 20 includes a left region located on a left side of the optical axis Ax (on a right side of the vehicle lamp 10 when viewed from the front side of the vehicle lamp 10), a right region located on a right side of the optical axis Ax, and a short inclined surface between the left region and the right region. The left region is formed by a first horizontal plane including the optical axis Ax. The right region is configured by a second horizontal plane that is at a lower height by one step than the left region. The short inclined surface connects the left region and the right region. A front edge 20*a* of the shade 20 extends from the rear focal point F toward both of the left and right sides.

Next, specific configuration of the light emitting unit 30 will be described.

The transparent member 34 of the light emitting unit 30 is configured by fifteen transparent segments 34A, 34B, 34C, 34D.

Each of the transparent segments 34A, 34B, 34C, 34D is a transparent plate made of a transparent resin (or made of glass) The transparent segments 34A, 34B, 34C, 34D extend along a vertical plane parallel to the optical axis Ax. The transparent segments 34A, 34B, 34C, 34D are disposed in parallel with each other along the right and left directions with side surfaces of the transparent segments 34A, 34B, 34C, 34D being in close contact with each other.

Each of the transparent segments 34A, 34B, 34C, 34D is has the same width in the right and left directions. Side surfaces of the transparent segments 34A 34B, 34C, 34D have substantially the identical shape to each other.

Each of the transparent segments 34A, 34B, 34C, 34D includes a front end surface 34*a*, a bottom surface 34*b*, a reflecting surface 34*c*, and the upper surface 34*d*. Each front end surface 34*a* is located in the rear focal plane of the projection lens 12 and extends along a vertical plane orthogonal to the optical axis Ax. Each bottom surface 34*b* has a planar shape. Also, when viewed in a side cross-section view (for example, FIGS. 1 and 3), each bottom surface 34*b* extends obliquely downward and rearward from a position below an intersection between the optical axis Ax and the corresponding front end surface 34*a*. Each reflecting surface 34*c* has a curved surface shape and extends upward from a rear edge of the bottom surface 34*b*. Each upper surface 34*d* has a planar shape and extends forward from an upper edge of the reflecting surface 34*c*.

When viewed from side, the front end surfaces 34*a* of the transparent segments 34A, 34B, 34C, 34D are located at the same position, the bottom surface 34*b* of the transparent segments 34A, 34B, 34C, 34D are located at the same position, and the reflecting surface 34*c* of the transparent segments 34A, 34B, 34C, 34D are located at the same position. On other hand, the upper surfaces 34*d* make up a portion of the shade 20. Therefore, the upper surfaces 34*d* are at different heights in accordance with positions where the transparent segments 34A, 34B, 34C, 34D are provided.

The seven transparent segments 34A make up the left region of the shade 20. The upper surfaces 34*d* of the seven transparent segments 34A are disposed in the first horizontal plane including the optical axis Ax. The six transparent segments 34D make up the right region of the shade 20. The upper surfaces 34*d* of the six transparent segments 34D are disposed in the second horizontal plane that is lower than the first horizontal plane including the optical axis Ax by one step. The transparent segment 34B is located at the optical axis Ax. The upper surface 34*d* of the transparent segment 34B is disposed so as to straddle (i) the first horizontal plane including the optical axis Ax and (ii) the short inclined surface. The transparent segment 34C is adjacent to the transparent segment 34B and is on a right side of the transparent segment 34B. The upper surface 34*d* of the transparent segment 34C is disposed so as to straddle (i) the short inclined surface and (ii) the second horizontal plane which is lower than the first horizontal plane including the optical axis Ax.

The upper surfaces 34*d* of the transparent segments 34A, 34B, 34C, 34D extend forward from the upper edges of the reflecting surfaces 34*c* along a horizontal direction. A front end portion of each upper surface 34*d* makes up a front reflecting surface 34*d*A extending obliquely downward and rearward from a front edge of the upper surface 34*d* (that is, the front edge 20*a* of the shade 20). Each of the transparent segments 34A, 34B, 34C, 34D is provided with an emission window 34*d*B that extends parallel to the front end surface 34*a* and that is disposed at a rear edge of the front reflecting surface 34*d*A.

Similarly to the upper surfaces 34*d*, mirror treatment is performed onto the front reflecting surfaces 34*d*A. It is noted that mirror treatment is not performed onto the emission windows 34*d*B.

Each of the transparent segments 34A, 34B, 34C, 34D is supported by the base member 22 at the bottom surface 34*b*.

Each light emitting element 32 is a white light emitting diode. The light emitting elements 32 are supported by the base member 22 in a state where the light emitting elements 32 are disposed below and near rear end regions of the bottom surfaces 34*b* of the transparent segments 34A, 34B, 34C, 34D. Each light emitting element 32 is disposed so that a light emitting surface 32*a* thereof faces obliquely upward and rearward in a direction that is orthogonal to the bottom surface 34*b*.

A recess portion 34*b*1 is formed in the rear end region of the bottom surface 34*b* of each of the transparent segments 34A, 34B, 34C, 34D. Each recess portions 34*b*1 has a semispherical shape and surrounds the light emitting surface 32*a* of the corresponding light emitting element 32. Light emitted from each light emitting element 32 is incident, at the recess portion 34*b*1, onto corresponding one of the transparent segments 34A, 34B, 34C, 34D.

Mirror treatment is performed on the reflecting surface 34*c* of each of the transparent segments 34A, 34B, 34C, 34D. Mirror treatment is also performed on portions, on a front side of the recess portions 34*b*1, of the bottom surfaces 34*b*.

Each of the transparent segments 34A, 34B, 34C, 34D internally reflects the light, which is incident from the corresponding light emitting element 32, forward at the reflecting surface 34*c*. Each reflecting surface 34*c* is configured by a substantially elliptical curved surface having a first focal point at the light emission center of the corresponding light emitting element 32. Each reflecting surface 34*c* is configured so that the reflected light is converged at a point that is located a little in front of the rear focal point F. The light reflected by the reflecting surface 34*c* of each of the transparent segments 34A, 34B, 34C, 34D is emitted forward through the corresponding front end surface 34*a* and the corresponding emission window 34*d*B.

The light emitted from the front end surfaces 34*a* are light that passes a portion, below the front edge 20*a* of the shade 20, of the rear focal plane of the projection lens 12. Also, the light emitted from the emission windows 34*d*B are light that passes a portion, above the front edge 20*a* of the shade 20, of the rear focal plane of the projection lens 12. Accordingly, of the light passing the rear focal plane of the projection lens 12, light that passes near the front edge 20*a* of the shade 20 is not lost. Moreover, a part of the light emitted from the emission windows 34*d*B is reflected upward by the front reflecting surfaces 34*d*A. Therefore, a large amount of light that passing near and above the front edge 20*a* of the shade 20 can be ensured.

Figure 5A:
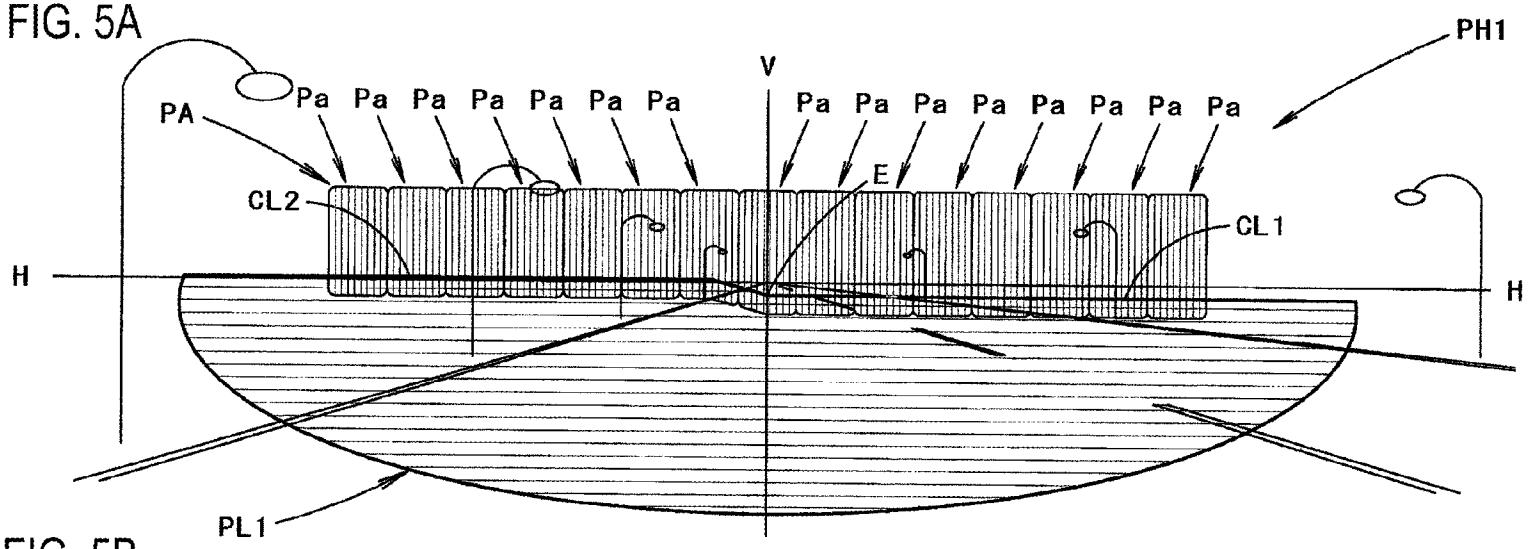
Figure 5B:
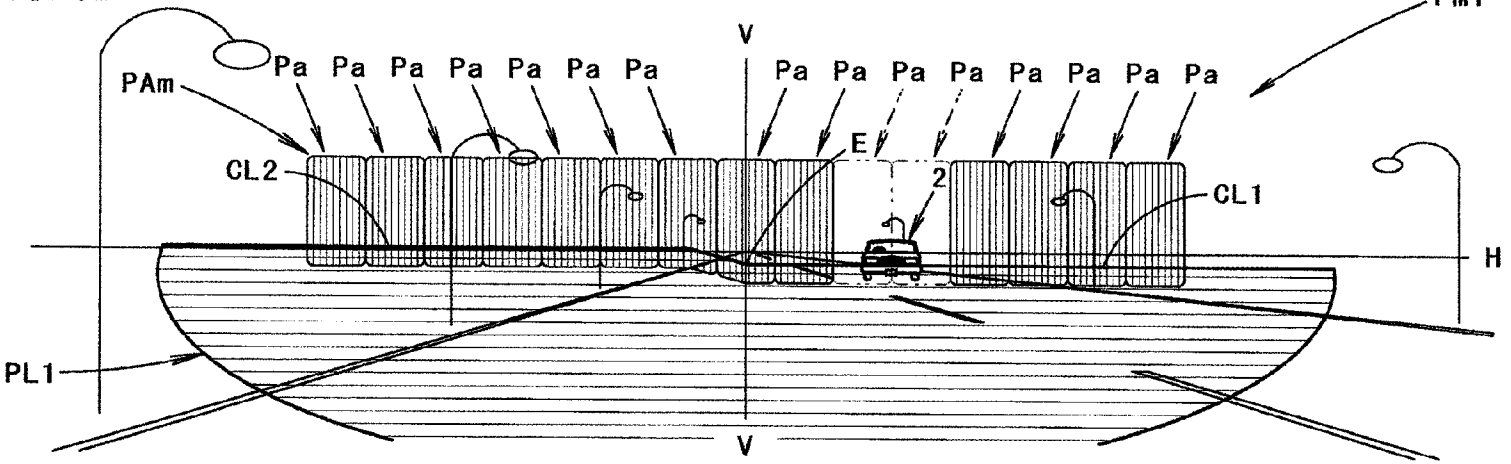

FIGS. 5A and 5B are views illustrating light distribution patterns formed on a virtual vertical screen located at a position 25*m* ahead of the vehicle lamp, by the light emitted forward from the vehicle lamp 10. In FIGS. 5A and 5B, the light distribution patterns are drawn to be seen through. FIG. 5 shows a high beam light distribution pattern PH1. FIG. 5B shows an intermediate light distribution pattern PM1.

The high beam light distribution pattern PH1 shown in FIG. 5A is a combined light distribution pattern, that is, a combination of a low beam light distribution pattern PL1 and a high beam supplementary light distribution pattern PA.

It is assumed that the low beam light distribution pattern PL1 is a left-hand-traffic low beam light distribution pattern. The low beam light distribution pattern PL includes cut-off lines CL1, CL2 on an upper end thereof. The cut-off lines CL1, CL2 are at different heights. The cut-off lines CL1, CL2 extend in the horizontal direction across a V-V line. The V-V line passes, in the vertical direction, through a point H-V that is a vanishing point ahead of the lamp. The lower cut-off line CL1 is formed on an oncoming-lane side, that is, on a right side of the V-V line. The upper cut-off line CL2 is formed on a running-lane side, that is, a left side of the V-V line. The upper cut-off line CL2 is formed at a higher position than the lower cut-off line CL1. An inclined portion is formed between the upper cut-off line CL2 and the lower cut-off line CL1 and connects the upper cut-off line CL2 and the lower cut-off line CL1.

The low beam light distribution pattern PL1 is formed by projecting a light source image of the light emitting element 14 as an inverted and projected image on the virtual vertical screen, using the projection lens 12. The light source image of the light emitting element 14 is formed at the rear focal plane of the projection lens 12 by the light emitted from the light emitting element 14 and reflected by the reflector 16. The cut-off lines CL1, CL2 are formed as an inverted and projected image of the front edge 20*a* of the shade 20.

In the low beam light distribution pattern PL1, an elbow point E is located approximately 0.5° to 0.6° below H-V. It is noted that the elbow point E is an intersection between the lower-step cut-off line CL1 and the V-V line.

In the high beam light distribution pattern PH1, the supplementary light distribution pattern PA is additionally formed as a laterally elongated light distribution pattern that extends around and above the cut-off lines CL1, CL2. Thereby, the high beam light distribution pattern Di illuminates a wide range of a road ahead of the vehicle.

The supplementary light distribution pattern PA is a combined light distribution pattern, that is, a combination of the fifteen light distribution patterns Pa.

Each light distribution pattern Pa is a light distribution pattern formed as an inverted and projected image of a light source image of the corresponding light emitting element 32. The light source image of each light emitting element 32 is formed at the rear focal plane of the projection lens 12 by the light emitted from corresponding one of the transparent segments 34A, 34B, 34C, 34D of the light emitting unit 30.

Each light distribution pattern Pa has a substantially rectangle shape which is somewhat elongated in the up and down directions. Each light distribution pattern Pa is formed so as to straddle the cut-off lines CL1, CL2. Upper edges of the light distribution patterns Pa are well above the cut-off lines CL1, CL2 and at the same height. Lower edges of the light distribution patterns Pa are located a certain distance below the cut-off lines CL1, CL2.

A part of each light distribution pattern Pa, which is above the cut-off lines CL1, CL2, is formed by the light emitted from the vertically elongated front end surface 34*a* of corresponding one of the transparent segments 34A, 34B, 34C, 34D. A portion of each light distribution pattern Pa, which is below the cut-off lines CL1, CL2, is formed by the light emitted from the horizontally elongated emission window 34*d*B of the corresponding one of the transparent segments 34A, 34B, 34C, 34D.

The intermediate light distribution pattern PM1 shown in FIG. 5B does not include the supplementary light distribution pattern PA in the high beam light distribution pattern PH1. Instead, the intermediate light distribution pattern PM1 includes a supplementary light distribution pattern PAm from which a portion of the supplementary light distribution pattern PA is missing.

Specifically, the supplementary light distribution pattern PAm is a light distribution pattern in which, of the fifteen light distribution patterns Pa, the fifth and sixth light distribution patterns Pa from the right are missing. The supplementary light distribution pattern PAm is formed by turning off the light emitting elements 32 which emit the light to be incident onto the fifth and sixth transparent segments 34A from left, from among the fifteen light emitting elements 32 of the light emitting unit 30.

Since such an intermediate light distribution pattern PM1 is formed, light from the vehicle lamp 10 does not illuminate an oncoming vehicle 2. Thereby, the vehicle lamp 10 can illuminate the running road ahead of the vehicle as broadly as possible so long as a glare is not given to a driver of the oncoming vehicle 2.

A shape of the supplementary light distribution pattern PAm may be varied by sequentially changing the light emitting elements 32 to be turned off in accordance with in a position of the oncoming vehicle 2. Thereby, the vehicle lamp 10 can illuminate the running road ahead of the vehicle as broadly as possible so long as a glare is not given to a driver of the oncoming vehicle 2.

It is detected by an on-vehicle camera (not shown) as to whether or not the oncoming vehicle 2 is present. If there is a preceding vehicle on the running road ahead of the vehicle or if there is a pedestrian on a road shoulder potion of the running road, the preceding vehicle and/or the pedestrian may be detected by the on-vehicle camera and some of the light distribution patterns Pa may be missed out so as to not give a glare to a driver of the preceding vehicle and/or the pedestrian.

Advantageous effects of the exemplary embodiment will be described below.

The vehicle lamp 10 according to the exemplary embodiment is configured to be a projector type lamp that selectively performs low beam illumination and high beam illumination. The vehicle lamp 10 includes the light emitting unit 30 for forming the high beam supplementary light distribution pattern PA. The light emitting unit 30 includes the transparent member 34 and the fifteen light emitting elements 32 (which serve as a second light source). The shade 20 blocks a part of the light from the light emitting element 14 (which serves as a first light source). The shade 20 is formed by performing surface treatment on the upper surface 34*d* of the transparent member 34. Also, the transparent member 34 is configured so that light, which is incident from the light emitting elements 32, is emitted toward the projection lens 12 from the front end surfaces 34*a* thereof and the emission windows 34*d*B of the upper surfaces 34*d*. This configuration provides the following advantageous effects.

The light emitted from the front end surfaces 34*a* of the transparent member 34 can form a basic shape of the high beam supplementary light distribution pattern PA. Also, the emitted light from the emission windows 34*d*B of the transparent member 34 can form the supplementary light distribution pattern PA so that the supplementary light distribution pattern PA extends to a region below the cut-off lines CL1, CL2 of the low beam light distribution pattern PL1.

Thereby, it is possible to prevent a gap between the low beam light distribution pattern PL1 and the supplementary light distribution pattern PA from being formed. Also, continuity between the low beam light distribution pattern PL1 and the supplementary light distribution pattern PA can be enhanced.

Also, according to the exemplary embodiment, the vehicle lamp 10 can selectively perform the high beam illumination and the low beam illumination. The vehicle lamp 10 can also form the high beam light distribution pattern PH1 with smooth continuity between the low beam light distribution pattern PL1 and the supplementary light distribution pattern PA.

In the transparent member 34 of the exemplary embodiment, the upper surfaces 34*d* include regions in front of the emission windows 34*d*B. The regions of the upper surfaces 34*d* make up the front reflecting surfaces 34*d*A extending obliquely downward and rearward from the front edges of the upper surfaces 34*d* (that is, the front edge 20*a* of the shade 20). Therefore, the front reflecting surfaces 34*d*A reflect a part of the light emitted from the emission windows 34*d*B, and the thus-reflected light can be utilized to form the high beam supplementary light distribution pattern PA. Thereby, the continuity between the low beam light distribution pattern PL1 and the supplementary light distribution pattern PA can be further enhanced.

Furthermore, in the exemplary embodiment, the transparent member 34 includes the fifteen transparent segments 34A, 34B, 34C, 34D which are disposed in parallel in the right and left directions. The fifteen light emitting elements 32 are disposed so that light emitted from the light emitting elements 32 is incident onto the transparent segments 34A, 34B, 34C, 34D, respectively. The light emitting elements 32 are configured so as to be capable of individually turned on. This configuration provides the following advantageous effects.

That is, the fifteen light emitting elements 32 may be simultaneously turned on to form the supplementary light distribution pattern PA. Thereby, the high beam light distribution pattern PH1 can be formed. Also, a part of the fifteen light emitting elements 32 may be selectively turned on to form the supplementary light distribution pattern PAm. In the supplementary light distribution pattern PAm, a portion of the supplementary light distribution pattern PA is missing. As a result, it is possible to form the intermediate light distribution pattern PH1 having an intermediate shape between the low beam light distribution pattern PL1 and the high beam light distribution pattern PH1.

The above advantageous effects can be achieved by the projector type optical system provided with the single projection lens 12. That is, the exemplary embodiment can form plural types of illumination patterns, that is, the high beam supplementary light distribution patterns PA, PAm by means of a compact configuration.

In the exemplary embodiment, the front end surfaces 34*a* and the emission windows 34*d*B of the transparent segments 34A, 34B, 34C, 34D extend in the vertical plane orthogonal to the optical axis Ax. Alternatively, the front end surfaces 34*a* and the emission windows 34*d*B may extend in a direction that is inclined toward the front and rear directions with respect to the vertical plane orthogonal to the optical axis Ax.

In the exemplary embodiment, the transparent member 34 includes the fifteen transparent segments 34A, 34B, 34C, 34D. The number of transparent segments is not limited thereto, but may be any desired number.

In the exemplary embodiment, the projection lens 12 may be configured so that a rear focal point of an upper region of the projection lens 12 is located below a rear focal point of other regions of the projection lens 12 than the upper region of the projection lens 12. Alternatively, a front surface of the projection lens 12 may have a function to diffuse light slightly. These configurations makes it possible to form the supplementary light distribution pattern PA having a more uniform light intensity distribution at the cut-off lines CL1, CL2.

A modification example of the exemplary embodiment will be described.

Figure 6:
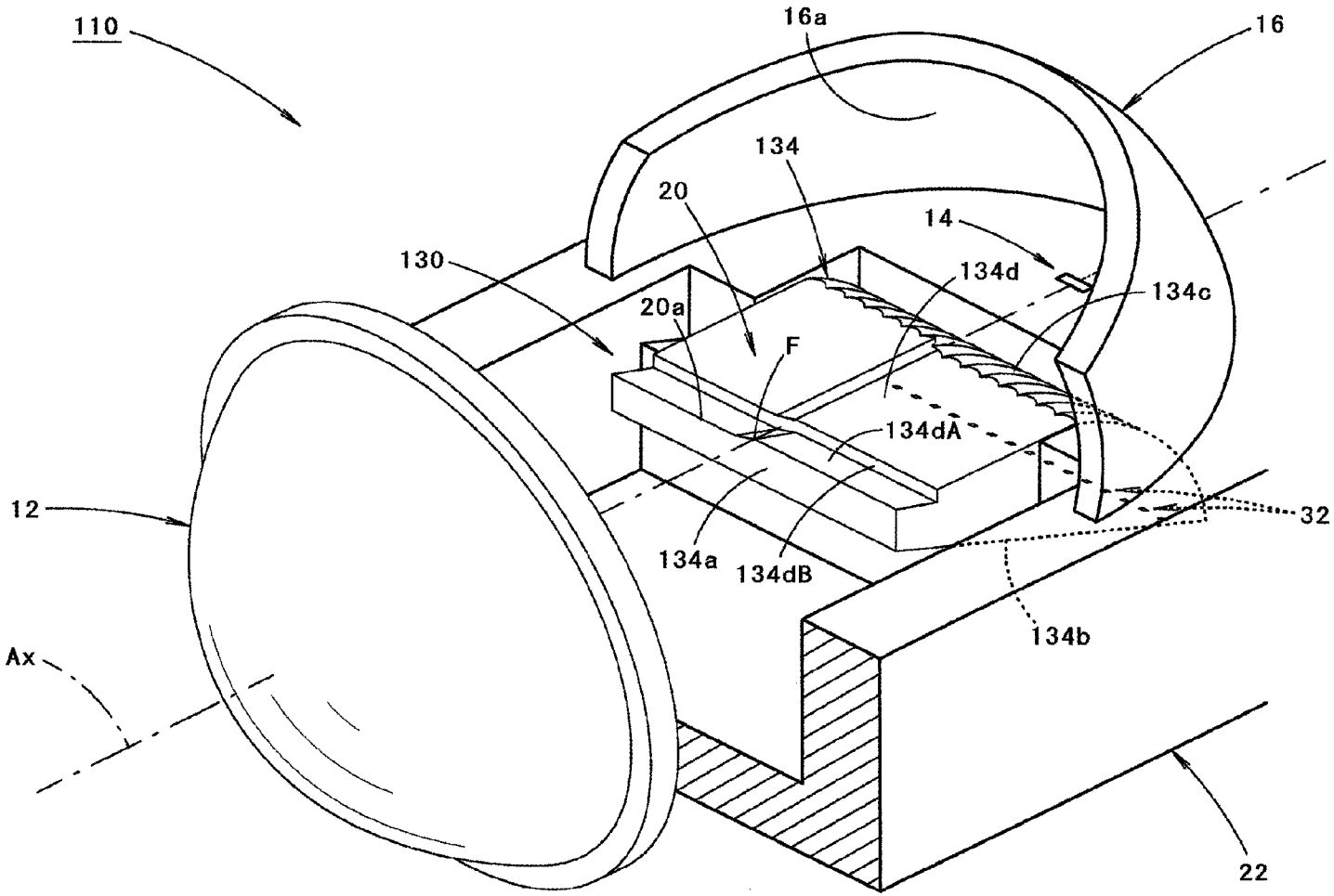
FIG. 6 is similar to FIG. 4 and shows a vehicle lamp according to a modification example of the exemplary embodiment.

FIG. 6 illustrates a vehicle lamp 110 according to the modification example and corresponds to FIG. 4.

As shown in FIG. 6, basic configuration of the vehicle lamp 110 is similar to that of the vehicle lamp 10 according to the exemplary embodiment. However, a light emitting unit 130 is different from the light emitting unit 30 of the exemplary embodiment.

That is, similarly to the light emitting unit 30 of the exemplary embodiment, the light emitting unit 130 of the modification example is configured to include a transparent member 134 and fifteen light emitting elements 32. The transparent member 134 is disposed below the rear focal point F of the projection lens 12. The light emitting elements 32 serve as a second light source. Light emitted from the light emitting elements 32 are incident onto the transparent member 134.

Unlike the exemplary embodiment, the transparent member 134 of the light emitting unit 130 of the modification example is configured by a single transparent resin member (or a single glass member). Also, the fifteen light emitting elements 32 are configured to be simultaneously turned on.

The transparent member 134 of the modification example is configured as if the fifteen transparent segments 34A, 34B, 34C, 34D of the exemplary embodiment are integrated. A front end face 134*a*, a bottom face 134*b*, reflecting surfaces 134*c*, an upper surface 134*d*, a front reflecting surface 134*d*A, and an emission window 134*d*B of the transparent member 134 are formed contiguously.

The fifteen light emitting elements 32 are disposed at the same positions as those in the exemplary embodiment.

Figure 7:
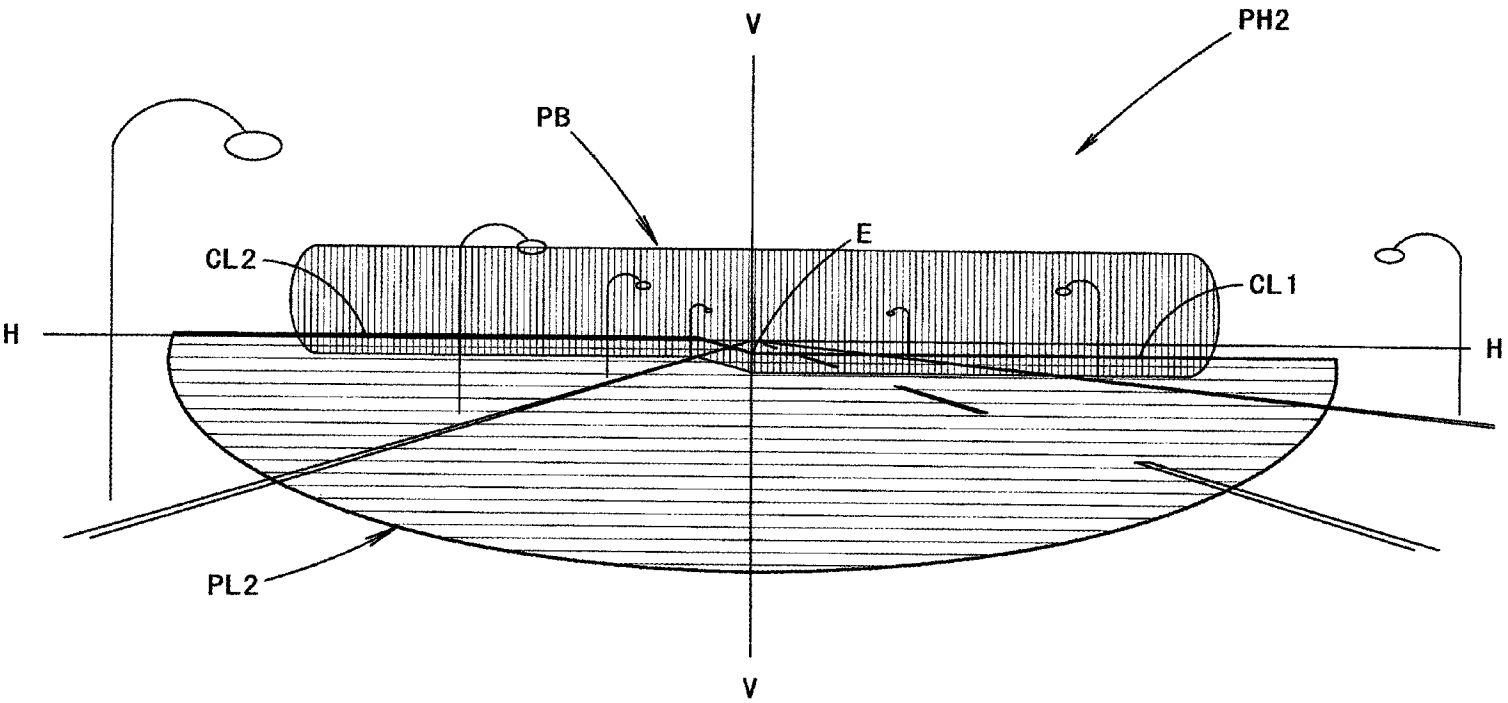
FIG. 7 is similar to FIGS. 5A and 5B and shows how the vehicle lamp according to the modification example operates.

FIG. 7 is a view illustrating a high beam light distribution pattern PH2 formed on the virtual vertical screen by light illuminated forward from the vehicle lamp 110. In FIG. 7, the high beam light distribution pattern PH2 is drawn to be seen through.

The high beam light distribution pattern PH2 is a combined distribution pattern, that is, a combination of a low beam light distribution pattern PL2 and a high beam supplementary light distribution pattern PB.

The low beam light distribution pattern PL2 is identical to the low beam light distribution pattern PL1 of the exemplary embodiment.

The supplementary light distribution pattern PB is a light distribution pattern formed by simultaneously turning on the fifteen light emitting elements 32 of the light emitting unit 130. The supplementary light distribution pattern PB is a laterally elongated light distribution pattern that extends around and above the cut-off lines CL1, CL2.

Similarly to the supplementary light distribution pattern PA of the exemplary embodiment, the supplementary light distribution pattern PB is formed to straddle above and below the cut-off lines CL1, CL2. An upper edge of the supplementary light distribution pattern PB extends in the horizontal direction to be well above the cut-off lines CL1, CL2. A lower edge of the supplementary light distribution pattern PB is located a certain distance below the cut-off lines CL1, CL2.

A portion, above the cut-off lines CL1, CL2, of the supplementary light distribution pattern PB is formed by the light emitted from the front end surface 134*a* of the transparent member 134. A portion, below the cut-off lines CL1, CL2, of the supplementary light distribution pattern PB is formed by the light emitted from the emission window 134*d*B of the upper surface 134*d*.

Where the configuration of the modification example is employed, the vehicle lamp 10 can selectively perform the low beam illumination and the high beam illumination. Also, it is possible to form the high beam light distribution pattern PH2 with smooth continuity between the low beam light distribution pattern PL2 and the supplementary light distribution pattern PB.

In the modification example, the light emitting unit 130 includes the fifteen light emitting elements 32. The number of the light emitting elements is not limited thereto, but may be any desired number.

In the modification example, the transparent member 134 of the light emitting unit 130 includes the fifteen reflecting surfaces 134*c* which are disposed in parallel. Alternatively, reflecting surfaces having another shape may be employed.

It should be noted that values given in the exemplary embodiment and modification example are merely examples and that various other values may be used appropriately.

The invention is not limited to the configurations of the exemplary embodiment and modification example. Various other modified configurations may be adopted.

What is claimed is:

1. A vehicle lamp configured so as to be capable of selectively performing low beam illumination and high beam illumination, the vehicle lamp comprising:

a projection lens;

a first light source; and a light emitting unit, the first light source and the light emitting unit disposed in rear of the projection lens, wherein:

light emitted from the first light source is irradiated forward through the projection lens, the light emitting unit is configured to cause light to be incident onto the projection lens to form a high beam supplementary light distribution pattern to the low beam light distribution pattern, the light emitting unit comprises:

a second light source; and a transparent member comprising:

a front end surface; and an emission window provided in an upper surface of the transparent member and in rear of a front edge of the upper surface, the upper surface of the transparent member comprising a shade configured to block a part of the light emitted from the first light source toward the projection lens to form a low beam light distribution pattern, the shade being configured by performing surface treatment on the upper surface of the transparent member, light emitted from the second light source is incident on the transparent member, the transparent member is configured to emit the light emitted from the second light source from the front end surface, the emission window is configured to emit the light, which is emitted from the second light source onto the transparent member, toward the projection lens, and wherein:

light emitted from the front end surface of the transparent member forms a basic shape of the high beam supplementary light distribution pattern, and the light emitted from the emission window of the transparent member forms the high beam supplementary light distribution pattern so that the high beam supplementary light distribution pattern extends to a region below cut-off lines of the low beam light distribution pattern.

2. A vehicle lamp configured so as to be capable of selectively performing low beam illumination and high beam illumination, the vehicle lamp comprising:

a projection lens; and a first light source disposed in rear of the projection lens, wherein light emitted from the first light source is irradiated forward through the projection lens, a shade and a light emitting unit are disposed in rear of the projection lens, the shade blocks a part of light heading from the first light source toward the projection lens to form a low beam light distribution pattern, the light emitting unit causes light to be incident onto the projection lens to form a high beam supplementary light distribution pattern additionally to the low beam light distribution pattern, the light emitting unit comprises a second light source, and a transparent member including a front end surface, light emitted from the second light source is incident on the transparent member, the transparent member is configured to emit the incident light from the front end surface, the shade is configured by performing surface treatment on an upper surface of the transparent member, and an emission window is formed in the upper surface of the transparent member and in rear of a front edge of the upper surface, and the emission window is configured to emit the light, which is incident from the second light source onto the transparent member, toward the projection lens, and wherein:

the upper surface of the transparent member comprises a region provided in front of the emission window, and the region of the upper surface of the transparent member comprises a front reflecting surface extending obliquely downward and rearward from the front edge of the upper surface.

3. The vehicle lamp of claim 1, wherein:

the transparent member comprises a plurality of transparent segments which are disposed in parallel in right and left directions, the second light source comprises a plurality of light emitting elements that are disposed so that light emitted from the plurality of light emitting elements is incident onto the transparent segments, respectively, and each of the plurality of light emitting elements is configured to be individually turned on.

4. The vehicle lamp of claim 2, wherein the transparent member comprises a plurality of transparent segments which are disposed in parallel in right and left directions, the second light source comprises a plurality of light emitting elements that are disposed so that light emitted from the plurality of light emitting elements is incident onto the transparent segments, respectively, and each of the plurality of light emitting elements is configured to be individually turned on.

* * * * *